US006305310B1

(12) United States Patent
Ferri

(10) Patent No.: US 6,305,310 B1
(45) Date of Patent: Oct. 23, 2001

(54) BOAT SAFETY NET SYSTEM

(76) Inventor: Stephanie L. Ferri, 7 Oakwood St., Blue Point, NY (US) 11715

( * ) Notice: Subject to any disclaimer, the term of this patent is extended or adjusted under 35 U.S.C. 154(b) by 0 days.

(21) Appl. No.: 09/675,173

(22) Filed: Sep. 29, 2000

(51) Int. Cl.[7] ..... B63B 8/00
(52) U.S. Cl. ..... 114/343; 114/362; 182/138
(58) Field of Search ..... 114/343, 362; 182/138, 139, 137, 142

(56) References Cited

U.S. PATENT DOCUMENTS

| | | | | |
|---|---|---|---|---|
| D. 356,644 | | 3/1995 | Henderson . | |
| 1,130,528 | | 3/1915 | Mcgray . | |
| 3,949,834 | | 4/1976 | Nusbaum . | |
| 4,294,331 | * | 10/1981 | Reynoir et al. | 182/191 |
| 4,372,243 | | 2/1983 | Roope, Jr. . | |
| 4,838,382 | | 6/1989 | Nusbaum . | |
| 4,860,683 | | 8/1989 | Sanguinetti . | |

* cited by examiner

*Primary Examiner*—Jesus D. Sotelo

(57) ABSTRACT

A boat safety net system for catching items falling between a dock and a boat. The boat safety net system includes a boat, a dock, and a net assembly, which is couplable to the boat and the dock. In an embodiment, a gangplank, which is positionable to extend between the boat and the dock, is positioned such that the net assembly extends between the boat and the dock below the gangplank for catching items falling from the gangplank.

14 Claims, 1 Drawing Sheet

BOAT SAFETY NET SYSTEM

BACKGROUND OF THE INVENTION

1. Field of the Invention

The present invention relates to safety nets and more particularly pertains to a new boat safety net system for catching items or persons falling between a boat and a dock or off the edge of a gangplank positioned between a boat and a dock.

2. Description of the Prior Art

The use of safety nets is known in the prior art. More specifically, safety nets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. Des. 356,644; U.S. Pat. No. 4,838,382; U.S. Pat. No. 3,949,834; U.S. Pat. No. 4,860,683; U.S. Pat. No. 1,130,528; and U.S. Pat. No. 4,372,243.

While these devices fulfill their respective, particular objectives and requirements, the aforementioned patents do not disclose a new boat safety net system. The inventive device includes a boat, a dock, and a net assembly, which is couplable to the boat and the dock. In an embodiment, a gangplank, which is positionable to extend between the boat and the dock, is positioned such that the net assembly extends between the boat and the dock below the gangplank for catching items falling from the gangplank.

In these respects, the boat safety net system according to the present invention substantially departs from the conventional concepts and designs of the prior art, and in so doing provides an apparatus primarily developed for the purpose of catching items falling between a boat and a dock or off the edge of a gangplank positioned between a boat and a dock.

SUMMARY OF THE INVENTION

In view of the foregoing disadvantages inherent in the known types of safety nets now present in the prior art, the present invention provides a new boat safety net system construction wherein the same can be utilized for catching items falling between a boat and a dock or off the edge of a gangplank positioned between a boat and a dock.

The general purpose of the present invention, which will be described subsequently in greater detail, is to provide a new boat safety net system apparatus and method which has many of the advantages of the safety nets mentioned heretofore and many novel features that result in a new boat safety net system which is not anticipated, rendered obvious, suggested, or even implied by any of the prior art safety nets, either alone or in any combination thereof.

To attain this, the present invention generally comprises a boat, a dock, and a net assembly, which is couplable to the boat and the dock. In an embodiment, a gangplank, which is positionable to extend between the boat and the dock, is positioned such that the net assembly extends between the boat and the dock below the gangplank for catching items falling from the gangplank.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new boat safety net system apparatus and method which has many of the advantages of the safety nets mentioned heretofore and many novel features that result in a new boat safety net system which is not anticipated, rendered obvious, suggested, or even implied by any of the prior art safety nets, either alone or in any combination thereof.

It is another object of the present invention to provide a new boat safety net system which may be easily and efficiently manufactured and marketed.

It is a further object of the present invention to provide a new boat safety net system which is of a durable and reliable construction.

An even further object of the present invention is to provide a new boat safety net system which is susceptible of a low cost of manufacture with regard to both materials and labor, and which accordingly is then susceptible of low prices of sale to the consuming public, thereby making such boat safety net system economically available to the buying public.

Still yet another object of the present invention is to provide a new boat safety net system which provides in the apparatuses and methods of the prior art some of the advantages thereof, while simultaneously overcoming some of the disadvantages normally associated therewith.

Still another object of the present invention is to provide a new boat safety net system for catching items falling between a boat and a dock or off the edge of a gangplank positioned between a boat and a dock.

Yet another object of the present invention is to provide a new boat safety net system which includes a boat, a dock, and a net assembly, which is couplable to the boat and the dock. In an embodiment, a gangplank, which is positionable to extend between the boat and the dock, is positioned such that the net assembly extends between the boat and the dock below the gangplank for catching items falling from the gangplank.

Still yet another object of the present invention is to provide a new boat safety net system that reduces injuries suffered by people falling off gangplanks.

Even still another object of the present invention is to provide a new boat safety net system that prevents objects falling off a gangplank from polluting the harbor area.

These together with other objects of the invention, along with the various features of novelty which characterize the invention, arc pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
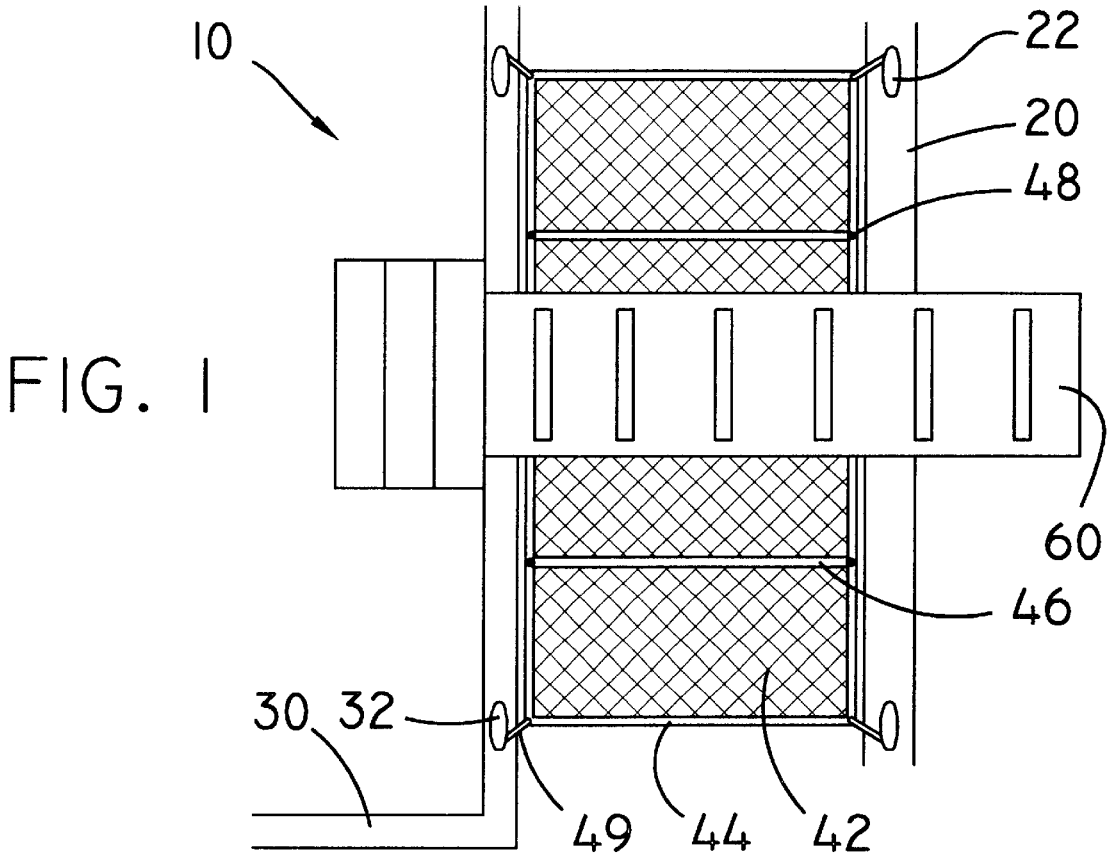
FIG. 1 is a schematic top view of a new boat safety net system according to the present invention.
Figure 2:
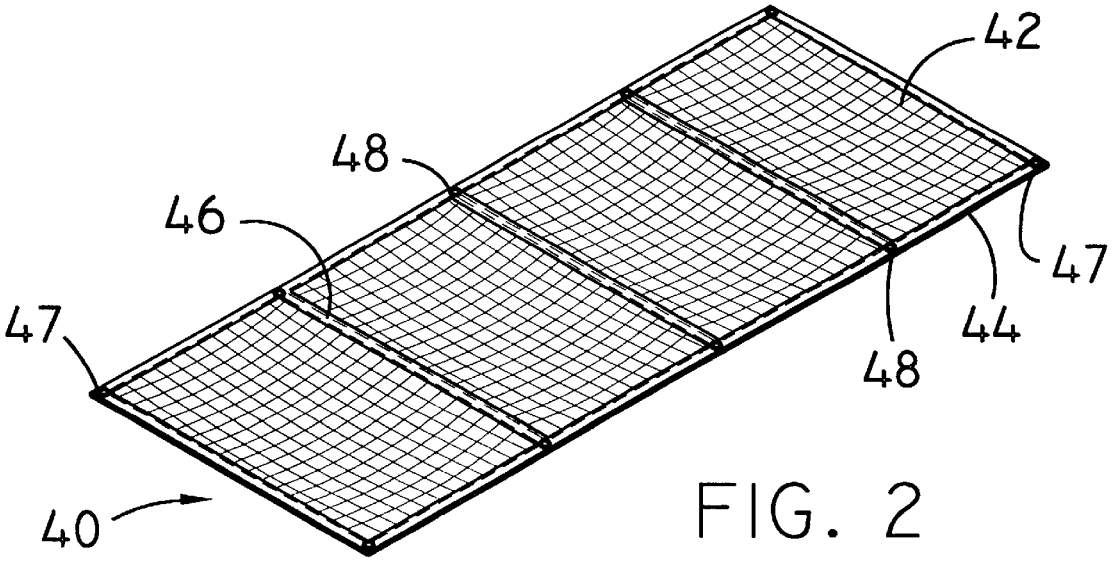
FIG. 2 is a schematic perspective view of the present invention.

With reference now to the drawings, and in particular to FIGS. 1 through 2 thereof, a new boat safety net system embodying the principles and concepts of the present invention and generally designated by the reference numeral 10 will be described.

As best illustrated in FIGS. 1 through 2, the boat safety net system 10 generally comprises a boat 20, a dock 30, a gangplank 60, and a net assembly 40.

The boat 20 includes a plurality of boat cleats 22. The dock 30 includes a plurality of dock cleats 32. The gangplank 60 is positionable to extend between the boat 20 and the dock 30.

The net assembly 40 is couplable to the boat 20 and the dock 30 such that the net assembly 40 extends between the boat 20 and the dock 30 below the gangplank 60. The net assembly 40 includes a width greater than a width of the gangplank 60 such that outer portions of the net assembly 40 extend outwardly from the gangplank 60. Thus the net assembly 40 is designed for catching an object falling over an edge of the gangplank 60.

The net assembly 40 includes a netting portion 42 and a border portion 44. The border portion 44 is coupled to a perimeter border of the netting portion 42 for reinforcing the perimeter edge of the netting portion 42 for preventing ripping of the netting portion 42.

The net assembly 40 includes a plurality of reinforcing strap portions 46. Each of the reinforcing strap portions 46 extends between opposite sides of the border portion 44 of the net assembly 40 for strengthening the netting portion 42 of the net assembly 40.

The reinforcing straps 46 divide the netting portion 42 into a plurality of netting panels.

The border portion 44 of the net assembly 40 is constructed from a substantially inelastic material. The border portion 44 of the net assembly 40 includes a plurality of grommets for facilitating coupling of the net assembly 40 to the boat 20 and the dock 30.

The plurality of grommets includes a plurality of corner grommets 47. Each of the corner grommets 47 is positioned in an associated corner of the border portion 44. The plurality of grommets includes a plurality of edge grommets 48. Each of the edge grommets 48 is positioned along an associated edge of the border portion 44. Each of the edge grommets 48 further is positioned in alignment with an associated one of the plurality of reinforcing straps 46.

The net assembly 40 includes a plurality of inelastic tie lines 49. Each of the tie lines 49 includes a proximal end. The proximal end is coupled to an associated one of the corner grommets 47. Each of the tie lines 49 includes a distal end. The distal end is removably couplable to an associated one of the boat cleats 22 and dock cleats 32. Thus the net assembly 40 is positionable to extend between the boat 20 and the dock 30.

In use, one side of the net assembly is tied to the dock cleats using the tie lines. The opposite side of the net assembly is then passed to a user on the boat. The user then ties the opposite side of the net assembly to the boat cleats using the tie lines. The user may then lower the gangplank, when one is provided, into position between the boat and the dock.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification arc intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boat safety net system comprising;

a boat;

a dock;

a gangplank positionable to extend between said boat and said dock; and a net assembly couplable to said boat and said dock such that said net assembly extends between said boat and said dock below said gangplank, said net assembly having a width greater than a width of said gangplank such that outer portions of said net assembly extend outwardly from said gangplank whereby said net assembly is adapted for catching an object falling over an edge of said gangplank.

2. The boat safety net system of claim 1, further comprising:

said boat having a plurality of boat cleats;

said dock having a plurality of dock cleats;

said net assembly including a plurality of tie lines, each of said tie lines being removably couplable to an associated one of said boat cleats and dock cleats whereby said net assembly is positionable to extend between said boat and said dock.

3. The boat safety net system of claim 1, further comprising:

said net assembly including a netting portion and a border portion, said border portion being coupled to a perimeter border of said netting portion for reinforcing said perimeter edge of said netting portion for preventing ripping of said netting portion.

4. The boat safety net system of claim 3, further comprising:

said net assembly including a plurality of reinforcing strap portions, each of said reinforcing strap portions extending between opposite sides of said border portion of said net assembly for strengthening said netting portion of said net assembly.

5. The boat safety net system of claim 3, further comprising:

said border portion of said net assembly having a plurality of grommets for facilitating coupling of said net assembly to said boat and said dock.

6. The boat safety net system of claim 3, further comprising:

said border portion of said net assembly being constructed from a substantially inelastic material.

7. A boat safety net system comprising;

a boat having a plurality of boat cleats;

a dock having a plurality of dock cleats;

a gangplank positionable to extend between said boat and said dock;

a net assembly couplable to said boat and said dock such that said net assembly extends between said boat and said dock below said gangplank, said net assembly having a width greater than a width of said gangplank such that outer portions of said net assembly extend outwardly from said gangplank whereby said net assembly is adapted for catching an object falling over an edge of said gangplank;

said net assembly including a netting portion and a border portion, said border portion being coupled to a perimeter border of said netting portion for reinforcing said perimeter edge of said netting portion for preventing ripping of said netting portion;

said net assembly including a plurality of reinforcing strap portions, each of said reinforcing strap portions extending between opposite sides of said border portion of said net assembly for strengthening said netting portion of said net assembly;

said reinforcing straps dividing said netting portion into a plurality of netting panels;

said border portion of said net assembly having a plurality of grommets for facilitating coupling of said net assembly to said boat and said dock;

said plurality of grommets including a plurality of corner grommets, each of said corner grommets being positioned in an associated corner of said border portion;

said plurality of grommets including a plurality of edge grommets, each of said edge grommets being positioned along an associated edge of said border portion, each of said edge grommets further being positioned in alignment with an associated one of said plurality of reinforcing straps;

said border portion of said net assembly being constructed from a substantially inelastic material; and said net assembly including a plurality of inelastic tie lines, each of said tie lines having a proximal end, said proximal end being coupled to an associated one of said corner grommets, each of said tie lines having a distal end, said distal end being removably couplable to an associated one of said boat cleats and dock cleats whereby said net assembly is positionable to extend between said boat and said dock.

8. A boat safety net system comprising;

a boat;

a dock; and a net assembly couplable to said boat and said dock such that said net assembly extends between said boat and said dock for catching an object falling between said boat and said dock.

9. The boat safety net system of claim 8, further comprising:

said boat having a plurality of boat cleats;

said dock having a plurality of dock cleats;

said net assembly including a plurality of tie lines, each of said tie lines being removably couplable to an associated one of said boat cleats and dock cleats whereby said net assembly is positionable to extend between said boat and said dock.

10. The boat safety net system of claim 8, further comprising:

said net assembly including a netting portion and a border portion, said border portion being coupled to a perimeter border of said netting portion for reinforcing said perimeter edge of said netting portion for preventing ripping of said netting portion.

11. The boat safety net system of claim 10, further comprising:

said net assembly including a plurality of reinforcing strap portions, each of said reinforcing strap portions extending between opposite sides of said border portion of said net assembly for strengthening said netting portion of said net assembly.

12. The boat safety net system of claim 10, further comprising:

said border portion of said net assembly having a plurality of grommets for facilitating coupling of said net assembly to said boat and said dock.

13. The boat safety net system of claim 10, further comprising:

said border portion of said net assembly being constructed from a substantially inelastic material.

14. The boat safety net system of claim 8, further comprising:

said boat having a plurality of boat cleats;

said dock having a plurality of dock cleats;

said net assembly including a plurality of tie lines, each of said tie lines being removably couplable to an associated one of said boat cleats and dock cleats whereby said net assembly is positionable to extend between said boat and said dock;

said net assembly including a netting portion and a border portion, said border portion being coupled to a perimeter border of said netting portion for reinforcing said perimeter edge of said netting portion for preventing ripping of said netting portion;

said net assembly including a plurality of reinforcing strap portions, each of said reinforcing strap portions extending between opposite sides of said border portion of said net assembly for strengthening said netting portion of said net assembly;

said border portion of said net assembly having a plurality of grommets for facilitating coupling of said net assembly to said boat and said dock; and said border portion of said net assembly being constructed from a substantially inelastic material.

* * * * *